United States Patent [19]

Ward

[11] Patent Number: 4,770,246

[45] Date of Patent: Sep. 13, 1988

[54] METHOD AND APPARATUS FOR FIRING BOREHOLE PERFORATING APPARATUS

[75] Inventor: Richard M. Ward, LaPorte, Tex.

[73] Assignee: Dresser Industries, Inc., Dallas, Tex.

[21] Appl. No.: 895,567

[22] Filed: Aug. 11, 1986

[51] Int. Cl.[4] ..... E21B 43/117

[52] U.S. Cl. ..... 166/297; 166/55.1; 175/4.54

[58] Field of Search ..... 166/297, 55.1; 175/4.54, 4.58

[56] References Cited

U.S. PATENT DOCUMENTS

| | | | |
|---|---|---|---|
| 2,304,408 | 12/1942 | Holifield | 164/0.5 |
| 3,040,808 | 6/1962 | Schramm et al. | 166/35 |
| 3,189,094 | 6/1965 | Hyde | 166/55.1 |
| 4,484,632 | 11/1984 | Vann | 166/297 |
| 4,484,639 | 11/1984 | Ayers | 175/4.56 |
| 4,509,604 | 4/1985 | Upchurch | 175/4.52 |
| 4,523,643 | 6/1985 | McGlothen | 166/297 |
| 4,544,034 | 10/1985 | George | 166/297 |
| 4,554,981 | 11/1985 | Davies | 175/4.52 |
| 4,560,000 | 12/1985 | Upchurch | 175/4.54 |
| 4,564,076 | 1/1986 | Vann et al. | 175/4.52 |
| 4,566,538 | 1/1986 | Peterson | 166/278 |
| 4,572,288 | 2/1986 | Kinley | 166/63 |
| 4,605,074 | 8/1986 | Barfield | 166/297 |
| 4,606,409 | 8/1986 | Peterson et al. | 166/297 |
| 4,616,718 | 10/1986 | Gambertoglio | 166/297 |
| 4,648,470 | 3/1987 | Gambertoglio | 166/55.1 X |

FOREIGN PATENT DOCUMENTS

| | | | |
|---|---|---|---|
| 48509 | 9/1985 | European Pat. Off. | 166/297 |
| 0154532 | 11/1985 | European Pat. Off. . | |

*Primary Examiner*—Jerome Massie, IV
*Assistant Examiner*—William P. Neuder
*Attorney, Agent, or Firm*—William R. Peoples; Jerry R. Selinger; Roger N. Chauza

[57] ABSTRACT

Method and apparatus for firing perforating apparatus in a borehole. A pressure actuated firing assembly is run into the borehole on th eend of a cable and latched onto a perforating apparatus. The cable is removed and pressure is applied to the tubing annulus. At a predetermined pressure the firing asembly is armed. After arming pressure is released from the tubing annulus during a time delay period before the firing assembly impacts a percussion firing head to thereby detonate the perforating apparatus.

15 Claims, 3 Drawing Sheets

METHOD AND APPARATUS FOR FIRING BOREHOLE PERFORATING APPARATUS

BACKGROUND OF THE INVENTION

This invention relates generally to subsurface well apparatus, more specifically, to apparatus for perforating subsurface earth formations, and particularly to pressure actuated apparatus for firing tubing conveyed perforating apparatus.

It has become common practice in the completion of oil and gas wells to perforate the well casings and the surrounding formations to bring a well into production. One method of providing this capability has a perforating apparatus attached to the end of a tubing string which is lowered and set in place when the perforating apparatus is opposite the formation to be produced. The perforating apparatus may then be detonated and the well placed into production through the tubing strings. One example of a tubing conveyed perforating apparatus can be found in U.S. Pat. No. 4,523,643, issued to J. R. McGlothen, and assigned to the assignee of the present invention, which is incorporated herein by reference.

The systems for firing the perforating devices have typically been either an electrical firing system or a non-electrical percussion firing system activated by dropping a member through the tubing. Neither method has been entirely satisfactory in the past. Electrical firing systems require care in connecting and running and can be activated from stray electrical currents. In addition, electrical connections can be short-circuited by moisture. Percussion firing systems commonly require a bar member, referred to as a "go devil", be dropped through the tubing string thereby impacting a percussion firing assembly. These percussion firing assemblies typically have some primary explosives in the perforating apparatus while it is affixed to the tubing and lowered into position within the well. As a result of the deficiencies of these systems, accidental and premature firings are a possibility. In addition, in a highly deviated well the bar member may not reach the perforating gun.

In an effort to overcome some of the deficiencies of the electrical and bar activated firing systems, various pressure responsive firing systems have been developed. In one typical embodiment an increased pressure is applied through the tubing string to the pressure responsive firing assembly. The increased pressure forces a firing pin into contact with an explosive detonator, thereby firing the perforating device. One such system is illustrated in U.S. Pat. No. 2,304,408, issued to A. J. Holifield. Systems of this type are unsatisfactory where the perforating operation is to be conducted under conditions of a pressure "underbalance", where the borehole pressure is less than formation fluid pressure. Such underbalance perforating operations have become common in the area of tubing conveyed perforating.

These and other disadvantages are overcome with the present invention by providing method and apparatus for firing subsurface perforating apparatus using a pressure actuated firing system for use when perforating in an underbalanced pressure condition.

SUMMARY OF THE INVENTION

In a preferred embodiment of the invention, a pressure actuated firing assembly for use in connection with a tubing conveyed perforating system is provided. The firing assembly is connected to a cable and lowered into engagement with the tubing conveyed perforating apparatus set within the well. The cable is removed and pressure is applied to the tubing annulus. At a predetermined pressure a shear member breaks, arming the firing assembly. Force is exerted upon an impact firing rod by a spring member causing fluid to move from a reservoir through a restricted flow path traversing a piston attached to the impact firing rod. The restricted flow path provides a predetermined time delay before the impact firing rod is released whereby the force exerted by a spring forces the firing rod into a percussion firing assembly to thereby detonate the percussion firing assembly and the attached perforating apparatus.

BRIEF DESCRIPTION OF THE DRAWINGS

The FIGS. 1A–1F are a longitudinal view, partly in cross-section of the pressure activated firing apparatus of the present invention.

DETAILED DESCRIPTION OF A PREFERRED EMBODIMENT

Figure 1A:
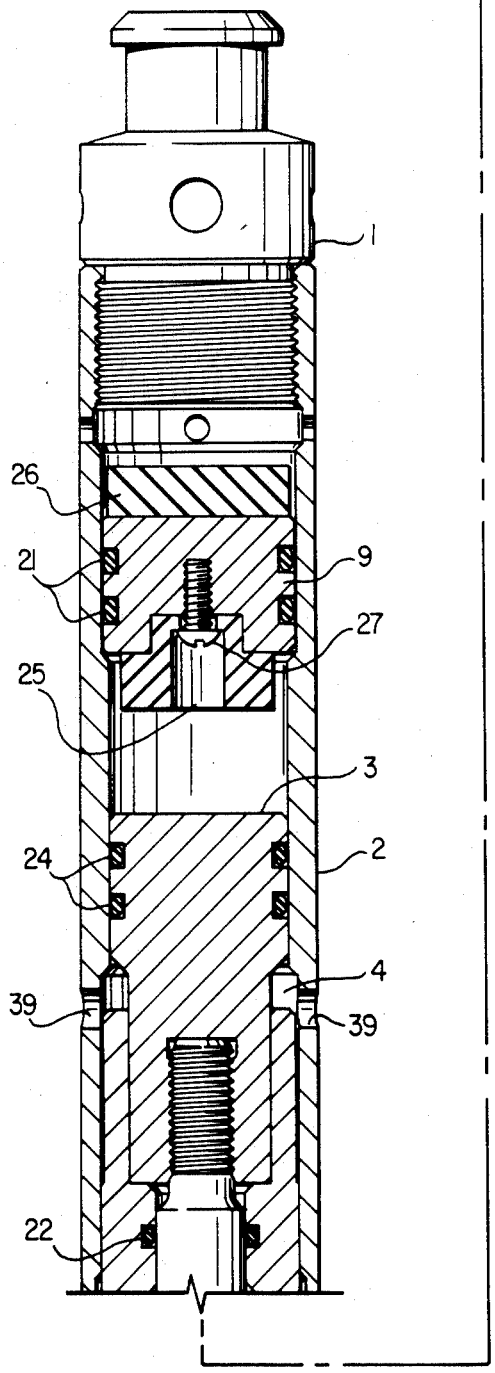
Figure 1B:
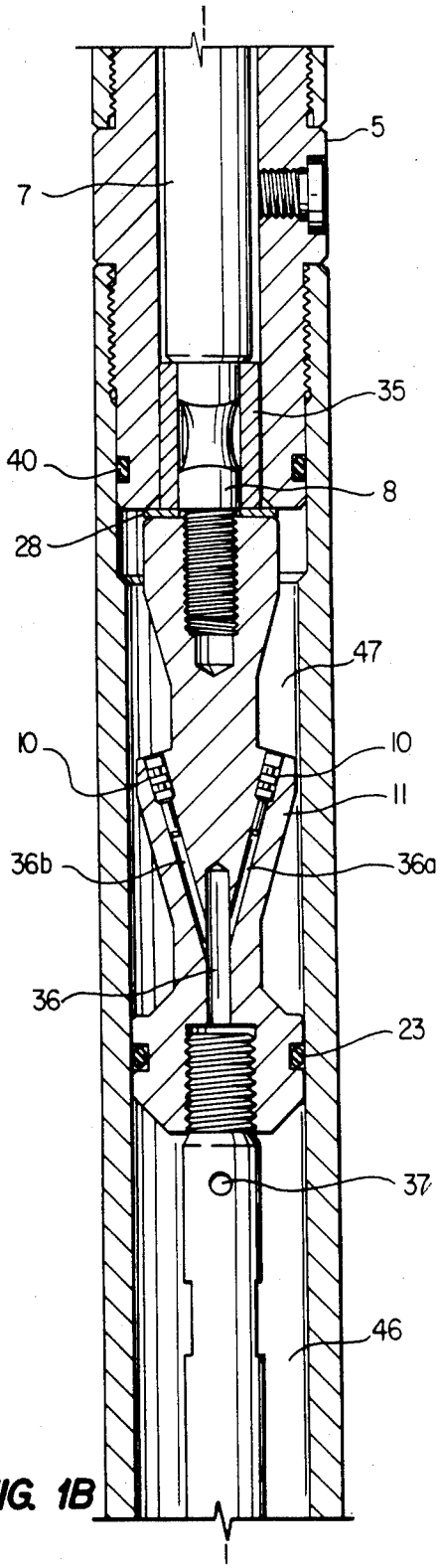
Figure 1C:
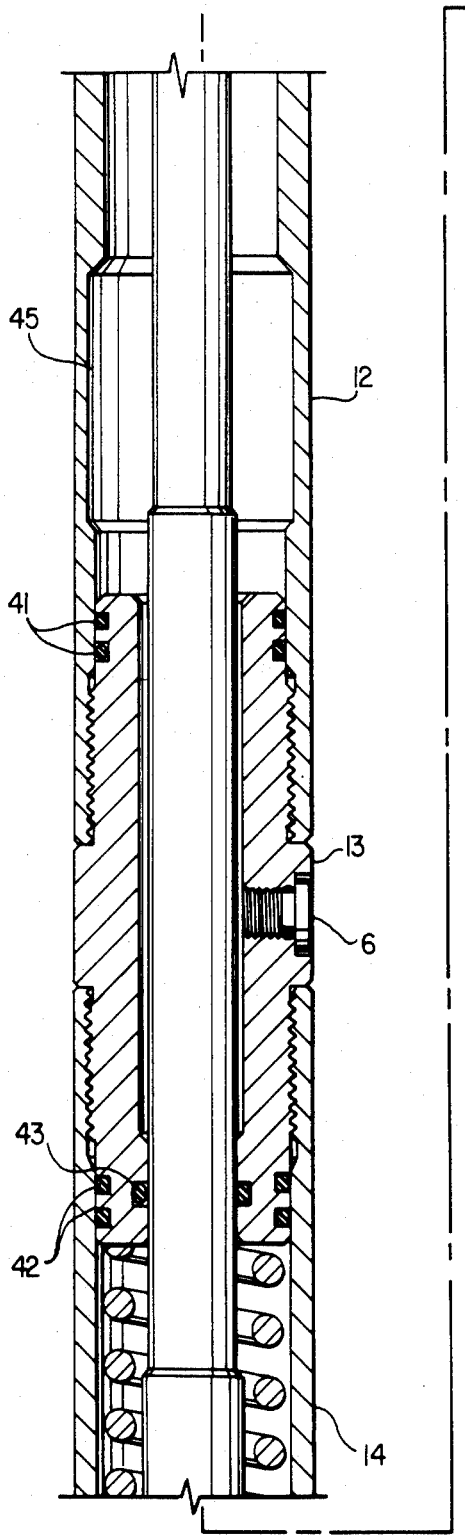
Figure 1D:
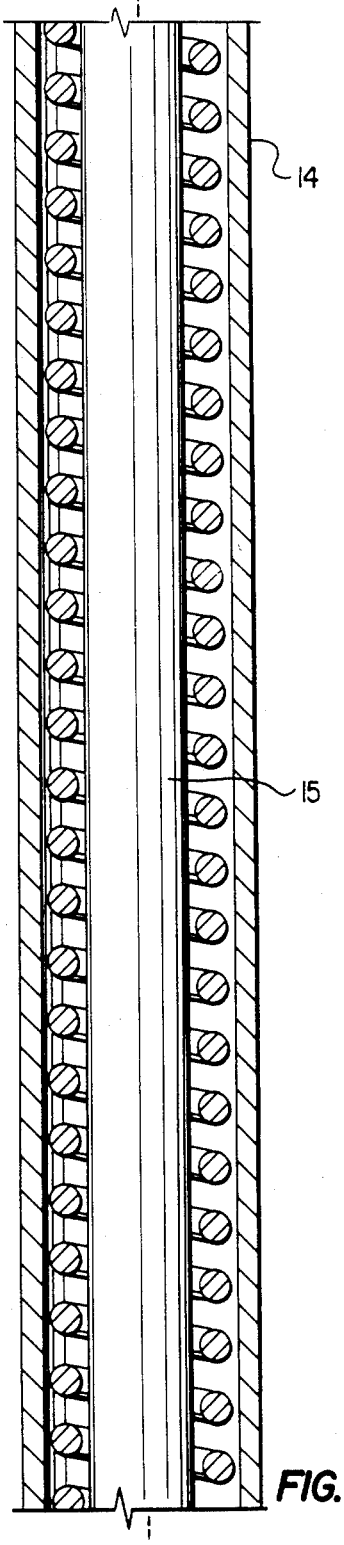
Figure 1E:
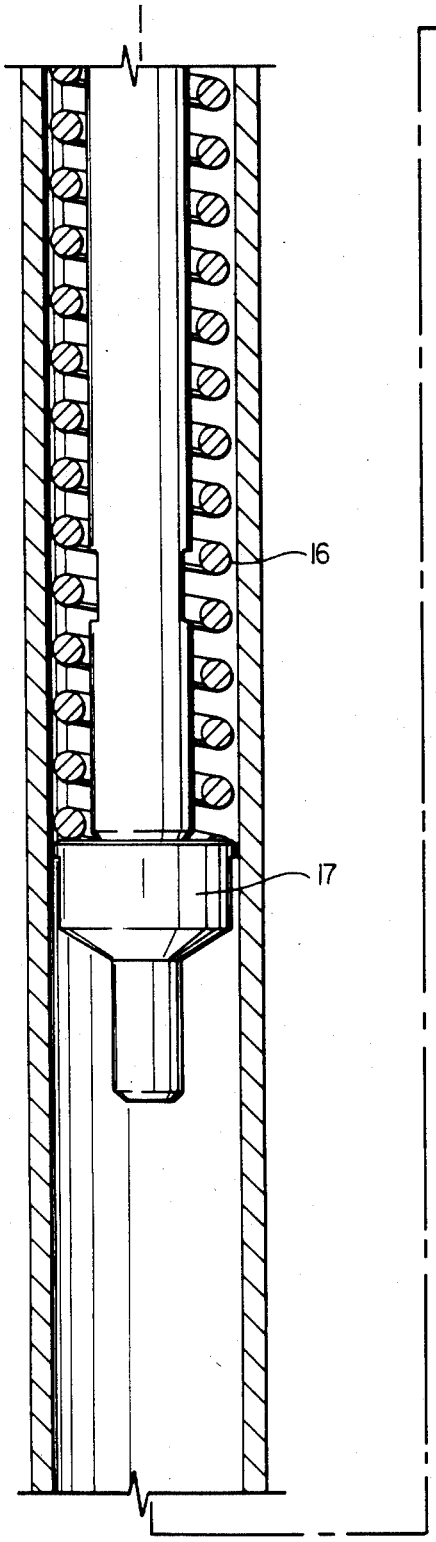
Figure 1F:
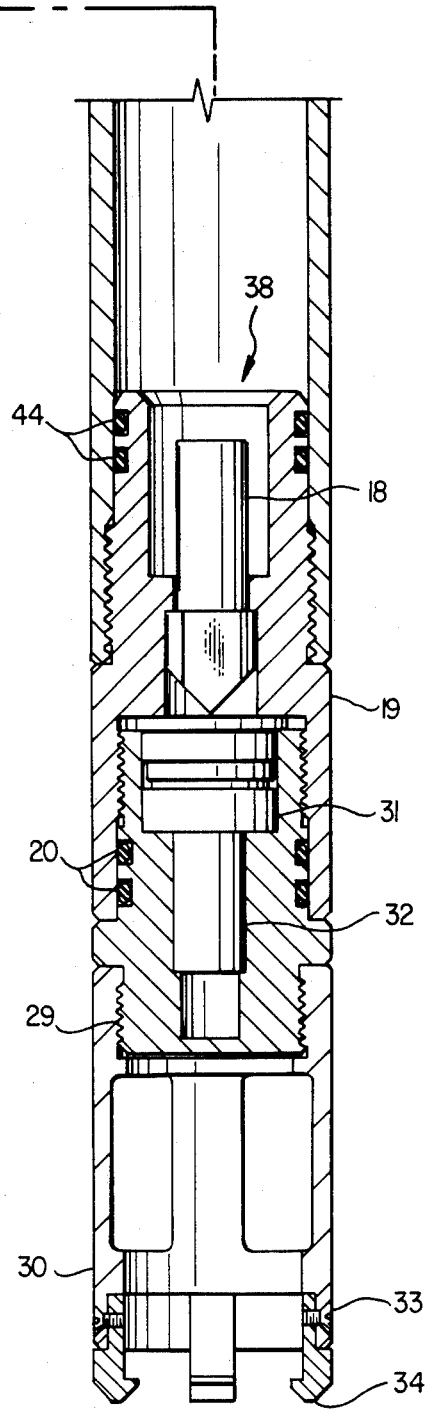

Referring now to the drawing in detail, therein is illustrated a section view of the firing apparatus in accordance with the present invention. The firing apparatus includes connector sub 1, commonly referred to as a fishing neck sub. Connector sub 1 has a first portion adapted for connection to a fishing tool in a manner common in the art, and is threadably attached to a first end of housing section 2. Coupled to connector sub 1, inside of housing section 2, is damper pad 26. Damping piston 9 is coupled to damper pad 26. Retained by screw 27 to damping piston 9 is impact pad 25. Impact pad 25 and damper pad 26 are made of a suitable shock absorbing material, such as rubber. Seal member 21 provides a fluid seal between damping piston 9 and housing section 2.

The second end of housing section 2 is threadably connected to coupling sub member 5, having a central, longitudinal bore therethrough and having an enlarged cavity portion in one end thereof. Piston member 3 has a first portion having an outer diameter slightly smaller than the inner diameter of housing section 2 and a second portion sized to fit within the cavity portion of coupling sub member 5. Seal members 24 provide a fluid seal between piston member 3 and housing section 2. Chamber 4 is formed within housing section 2 in the area between piston member 3 and coupling member 5. Chamber 4 is in fluid communication with the tubing annulus (not shown) by ports 39.

Threadably connected to piston member 3 is one end of rod member 7. Rod member 7 is disposed within the central bore of coupling sub member 5, with a fluid seal therebetween provided by seal member 22. Coupled to the other end of rod member 7 is pull-apart bar 8, surrounded by sleeve member 35.

Housing section 12 is threadably connected at one end to coupling sub member 5. Seal member 40 provides a fluid seal between coupling sub member 5 and housing section 12. Disposed within housing section 12 and threadably connected to bar 8 is piston member 11. Spacer 28 is disposed between bar 8 and piston member 11. Seal member 23 provides a fluid seal between piston member 11 and housing section 12.

Piston member 11 has a fluid passage 36 terminating at one end in an internally threaded cavity portion. Further, fluid passage 36 branches into passages **36*a*** and 36*b*. Retained within passages 36*a* and 36*b* are flow restrictor valves 10.

Coupled to the second end of housing section 12 is coupling sub member 13, having a central, longitudinal bore therethrough. A port, sealed by removeable plug 6, communicates through coupling sub member 13 to the longitudinal bore. Seal member 41 provides a fluid seal between coupling sub member 13 and housing section 12. The other side of coupling sub member 13 is threadably connected to housing section 14. Seal members 42 provide a fluid seal between housing section 14 and coupling sub member 13.

Disposed centrally within housing section 12, the central bore of coupling sub member 13 and housing section 14 is rod member 15. Rod member 15 is threadably connected at a first end to piston member 11. A central fluid passage in a portion of rod member 15 communicates through port 37 to fluid passage 36 in piston member 11. Seal member 43 provides a dynamic fluid seal between rod member 15 and coupling sub member 13. It should be noted that a reservoir 46 for retaining a fluid, such as oil, is formed in the central bore of coupling sub member 13 and housing section 12, below piston member 11. The reservoir 46 fluidly communicates with the reservoir 47 in housing section 12, above piston member 11, through port 37 and fluid passage 36. The reservoir 46 can be filled with such fluid through the port sealed by removable plug 6.

Coupled to the other end of rod member 15 is striker 17. Disposed in the internal cavity of housing section 14, about rod member 15, is spring member 16. Spring member 16 is a helical compression spring. A first terminus of spring member 16 is in contact with the face of coupling sub member 13. The second terminus of spring member 16 contacts the face of striker 17, which includes a tang portion extending therefrom.

Coupled to the end of housing section 14 is firing head assembly 38 having a fluid seal therebetween formed by seal members 44. Firing head assembly 38 includes firing pin 18, retained within firing pin sub 19, having an extended portion for contact with striker 17. Located adjacent firing pin 18 is explosive primer assembly 31 proximate shaped charge 32, having an axis of perforation aligned substantially along the longitudinal axis of the assembly. Grapple sub 29 includes a generally cylindrical portion having a plurality of elongated fingers 30 extending therefrom, which terminate with inwardly directed dogs 34. Dogs 34 are attached to fingers 30 by means of shear screws 33. A more complete description of the firing head assembly 38 can be found in U.S. Pat. No. 4,484,639, which is incorporated herein by reference.

In overall operation, the components of the tubing conveyed perforating system are assembled and lowered into the well, and the packer set to isolate the zone to be perforated. The firing apparatus is connected to a cable, preferably a non-electrical slick line, at connector sub 1 by means of a fishing tool common in the art. The firing apparatus is lowered through the tubing until grapple sub 29 engages, and latches onto, a firing head within a tubing conveyed perforating apparatus having been set previously within the well in a manner common in the art. In the preferred embodiment grapple sub 29 will latch onto the perforating apparatus firing head at approximately fifteen pounds of downward force. After the firing assembly is latched onto the perforating apparatus, tension is pulled on the cable thereby causing the fishing tool to release from connector sub 1. The cable is then removed from the well.

To actuate the firing apparatus pressure within the tubing string is increased by means of a pump (not shown) located at the earth's surface or by gas pressure. The increase in pressure causes a corresponding pressure increase in chamber 4 by way of ports 39. When the pressure within chamber 4 exceeds the tensile rating of pull-apart bar 8, bar 8 will shear, mechanically decoupling bar 7 from piston 11, arming the firing apparatus. Piston member 3, with rod member 7 attached thereto, will be driven by the pressure within chamber 4 through housing section 2 into contact with impact pad 25. Therefore, when bar 8 shears and piston member 3 impacts impact pad 25 the impact is dampered without damage to the housing in connector sub 1. Impact pad 25 and thus possible damper pad 26 prevent metal-to-metal contact and damage to piston member 3 and damping piston 9. In the preferred embodiment bar 8 is selected in view of well conditions. More specifically, bar 8 can be selected to break at a pressure between approximately 2,000 to 15,000 p.s.i.

In order to perforate the formations in an underbalanced pressure condition, once the firing apparatus is armed pressure is released from the tubing string. To allow sufficient time delay for the pressure to be reduced the firing apparatus is provided with a preselected time delay between arming and firing. Once armed the force exerted on rod member 15 and thus piston 11 coupled thereto by spring member 16 will force fluid from the reservoir 46 within housing section 12 through port 37 and fluid passage 36 to reserves 47 on the other side of piston member 11. Flow restrictor valves 10 provide a restriction to the fluid migration from reservoir 46 to reservoir 47, thereby restricting the longitudinal travel of piston 11 and rod member 15. Flow valves 10 can be selected to provide a number of preselected time delays. In the preferred embodiment delays of eight, fifteen, twenty, twenty-five and thirty-five minutes can be selected by changing of flow valves 10.

As fluid is displaced from reservoir 46 to reservoir 47 through flow valves 10, piston member 11 will continue to move slowly downwardly within housing section 12 until seal member 23 on piston 11 enters the enlarged inner diameter section 45 of housing section 12. At that point fluid is allowed to pass around seal 23 on piston member 11, reducing fluid resistance to longitudinal movement of piston member 11, and spring member 16 will drive rod member 15 downward causing striker 17 to impact firing pin 18. Firing pin 18 will be driven into explosive primer assembly 31 thereby igniting shaped charge 32. A more complete description of the ignition of firing head assembly 38 is contained in the aforementioned U.S. Pat. No. 4,484,639.

Once the firing operation is complete, or should a failure of the firing assembly occur, a fishing tool can be lowered into the well attaching to connector sub 1. Upward tension is applied through the cable until screws 33 shear allowing dogs 34 to disconnect from fingers 30. The firing assembly can then be removed from the well. Subsequently another firing assembly can be lowered into place or the perforating apparatus can be removed from the well.

Many modifications and variations besides those specifically mentioned herein may be made in the techniques and structures described herein and depicted in the accompanying drawings without departing substantially from the concept of the present invention. Accordingly, it should be clearly understood that the form of the invention described and illustrated herein is exemplary only, and is not intended as a limitation on the scope of the present invention.

The embodiments of the invention in which an exclusive property of privilege is claimed are defined as follows:

1. A method of firing a perforating gun disposed on a tubing string within a borehole, comprising the steps of:

increasing the pressure within said tubing string to a predetermined pressure level;

arming a firing assembly in response to said predetermined pressure increase level;

moving an actuator toward said perforating gun after said firing assembly is armed; and delaying the firing of said perforating gun by a predetermined period of time during a first part of said actuator movement, said predetermined period of time being substantially independent of borehole temperature, and accelerating said actuator during a second part of the movement thereof for firing said perforating gun.

2. The method of claim 1 further comprising the step of releasing the pressure within said tubing string subsequent to said arming of said firing assembly.

3. The method of claim 1 further comprising the step of lowering said firing assembly into engagement with said perforating gun disposed within said borehole.

4. Pressure actuated apparatus for firing a perforating gun disposed within a borehole, comprising:

an elongated housing member;

means associated with said housing member for arming said firing apparatus in response to a fluid pressure in said housing member;

said arming means including a piston moveable in a fluid chamber and fixed to said housing member by a shear member which is shearable in response to said fluid pressure, a striker fixed to said piston and spring biased to move in a direction for firing said perforating gun;

metered fluid displacement means for restricting movement of said piston for delaying the firing of said perforating gun for a predetermined time period, said fluid displacement means including a fluid jet in said piston for transferring fluid in a metered manner from one side of said piston to another side thereof such that the movement of said piston is slow to thereby effect said firing delay; and means for releasing fluid pressure on one side of said piston after said delay to accelerate said striker toward said perforating gun.

5. The pressure actuated apparatus of claim 4 wherein said means for arming further comprises:

a first piston member movably disposed within said housing member, said first piston member being responsive to pressure; and a shear member connected to said first piston member, said shear member selected to break in response to a predetermined pressure on said first piston.

6. The pressure actuated apparatus of claim 5 wherein said means for delaying the firing of said perforating gun further comprises:

a second piston member movably disposed within said housing member, said second piston member including a fluid passage therethrough; and a flow restrictor retained within said fluid passage for limiting the flow of fluid therethrough.

7. The pressure actuated apparatus of claim 4 wherein said means for releasing fluid pressure comprises a widened bore in said piston fluid chamber.

8. Apparatus adapted to be lowered into a borehole for firing a perforating gun disposed on a tubing string, comprising:

an elongated housing member;

a first piston disposed within said housing member, said first piston being slidable in response to pressure within said tubing string;

a second piston coupled to said first piston, said second piston being slidably disposed within said housing member;

means for decoupling said second piston from said first piston in response to said pressure;

a rod member coupled to said second piston;

biasing means disposed about at least a portion of said rod member for exerting a force on said rod member for longitudinal movement of said rod member and said second piston in response to the decoupling of said second piston from said first piston; and means for restricting the longitudinal movement of said rod member and said second piston for a predetermined time period after decoupling of said second piston from said first piston.

9. The apparatus of claim 8 further comprising an impact sensitive firing head coupled to said housing member including an impact firing pin substantially in line with said rod member

10. The apparatus of claim 9 wherein said firing head further comprises a grapple end portion for engaging said perforating gun.

11. The apparatus of claim 10 wherein said grapple end portion further comprises a plurality of fingers terminating with inwardly directed dogs.

12. The apparatus of claim 9 wherein said decoupling means further comprises a tensile bar coupled between said first and said second pistons.

13. The apparatus of claim 12 wherein said restricting means further comprises at least one flow restriction valve to restrict fluid flow across said second piston.

14. Presure actuated apparatus for firing a perforating gun disposed within a borehole, comprising:

an elongated housing member;

means for arming said firing apparatus in response to pressure, including a first piston member movably disposed within said housing member, said first piston member being responsive to a predetermined pressure;

a shear member connected to said first piston member, said shear member selected to separate in response to said pressure on said first piston;

fluid displacement means responsive to said arming means for delaying the firing of said perforating gun for a predetermined time period, including a second piston member movably disposed within said housing member, said second piston member including a fluid passage therethrough; and a flow restrictor retained within said fluid passage for limiting the flow of fluid therethrough.

15. Pressure actuated apparatus for firing a perforating gun disposed within a borehole, comprising:

an elongated housing member;

means associated with said housing member for arming said firing apparatus in response to a fluid pressure in said housing member, said arming means including a first piston member movably disposed within said housing member, said first piston member being responsive to pressure, and a shear member connected to said first piston member, said shear member selected to separate in response to a predetermined pressure on said first piston; and metered fluid displacement means for restricting movement of said firing apparatus for delaying the firing of said perforating gun for a predetermined time period, said means for restricting including a second piston member movably disposed within said housing member, said second piston member including a fluid passage therethrough, and a flow restrictor retained within said fluid passage for limiting the flow of fluid therethrough.

* * * * *